US012721485B2

(12) United States Patent
Xiong

(10) Patent No.: US 12,721,485 B2
(45) Date of Patent: Sep. 1, 2026

(54) MANICURE DUST SUCTION DEVICE

(71) Applicant: SHENZHEN WEILAI NAIL ART CO., LTD, Shenzhen City (CN)

(72) Inventor: Pingping Xiong, Shenzhen City (CN)

(73) Assignee: SHENZHEN WEILAI NAIL ART CO., LTD, Shenzhen City (CN)

( * ) Notice: Subject to any disclaimer, the term of this patent is extended or adjusted under 35 U.S.C. 154(b) by 372 days.

(21) Appl. No.: 18/523,898

(22) Filed: Nov. 30, 2023

(65) Prior Publication Data

US 2025/0072578 A1 Mar. 6, 2025

(30) Foreign Application Priority Data

Sep. 2, 2023 (CN) ..... 202322394428.6

(51) Int. Cl.
*A47L 7/00* (2006.01)
*A45D 29/00* (2006.01)

(52) U.S. Cl.
CPC ..... *A47L 7/0066* (2013.01); *A45D 29/00* (2013.01)

(58) Field of Classification Search
CPC ..... A47L 7/0066
See application file for complete search history.

(56) References Cited

U.S. PATENT DOCUMENTS

2022/0338690 A1* 10/2022 Tang ..... A47L 11/4097
2023/0211269 A1* 7/2023 Hsieh ..... B01D 46/0005 96/226
2025/0031829 A1* 1/2025 Sun ..... A45D 29/00

OTHER PUBLICATIONS

Won (KR 20220063920 A) + machine translation (Year: 2022).*
Kiso (JP 2006034661 A) + machine translation (Year: 2006).*
KR 20200001835 U + machine translation (Year: 2020).*
Kwon (KR 101763923 B1) + machine translation (Year: 2017).*
Jin (CN 204048530 U) + machine translation (Year: 2014).*
Henning (EP 1707071 A1) + machine translation (Year: 2006).*

* cited by examiner

*Primary Examiner* — Juan G Flores
(74) *Attorney, Agent, or Firm* — Li & Cai Intellectual Property Office

(57) ABSTRACT

A manicure dust suction device relating to the field of manicure technology is provided, including a housing having a cavity and a dust suction port provided on the housing. The dust suction port has a first end and a second end, the first end is higher than the second end, the housing is further provided with an air suction mechanism for providing a suction force to the dust suction port.

12 Claims, 5 Drawing Sheets

MANICURE DUST SUCTION DEVICE

FIELD OF THE DISCLOSURE

The present disclosure relates to the technical field of manicure, and more particularly to a manicure dust suction device.

BACKGROUND OF THE DISCLOSURE

At present, with the continuous development of the beauty industry, nail art and manicure have become part of the life of urban fashionable women.

When a manicurist is polishing or removing nails for customers, a large amount of dust particles will be generated during the operation of the high-speed grinding machine. The dust particles will float in the air with the inertia of the high-speed operation of the grinding machine to affect the customer's experience, and manicurists are in such a working environment and suction dust particles for a long time, so that the risk of suffering from pneumoconiosis occupational diseases increases. Therefore, a manicure dust suction device is usually provided to suck dust particles when polishing nails.

Currently, manicure dust suction devices on the market mainly include a housing, a suction port provided on the top surface of the housing, and a fan mounted in the housing. When polishing nails, the manicurist holds the customer's hand with one hand and places it above dust suction port, and holds the grinder with the other hand to polish the customer's nails. By means of the settings of the fan and suction port, the dust particles generated from polishing nails are adsorbed, thereby reducing the risk of manicurists suffering from pneumoconiosis occupational diseases.

However, because the grinder rotates very fast, a large number of dust particles generated when polishing nails will rise up and fly around, and most of the dust particles fly towards the manicurist, and dust suction port is located at the manicurist, so that the collection effect of dust particles is not good under the customer's fingers, resulting in more dust particles floating around the manicurist's area and making it difficult to protect the health of the manicurist.

SUMMARY OF THE DISCLOSURE

The purpose of the present disclosure is to solve the problem that the manicure dust suction device in the prior art produces a large amount of dust particles when grinding nails, which will rise upward and fly around, and most of the dust particles fly to the direction of the manicurist. The dust suction port is located under the fingers of the manicurist and the customer, and the dust particle collection effect is not good, resulting in more dust particles floating around the manicurist and making it difficult to protect the health of the manicurist. The purpose of the present disclosure is to provide a manicure dust suction device.

In order to solve the above-mentioned problems, the present disclosure provides a manicure dust suction device, including a housing having a cavity and a dust suction port provided on the housing. The dust suction port has a first end and a second end, the first end is higher than the second end. The housing is further provided with an air suction mechanism for providing a suction force to the dust suction port so that the dust suction port is capable of collecting dust particles generated during nail polishing and nail removal.

In preferred embodiments, the first end is connected to the second end, a connection between the first end and the second end is arranged in a circular arc, and the first end and the second end complement each other to form an "8" shape.

In preferred embodiments, the housing is provided with a wind power distribution mechanism for distributing the suction force provided by the air suction mechanism so that a suction force at the first end is greater than a suction force at the second end.

In preferred embodiments, the wind power distribution mechanism has a fixed cavity fixedly provided in the housing, an air suction port provided on a side wall of the fixed cavity, and a wind power distribution network provided on the fixed cavity. The fixed cavity is fixedly located in the cavity, the air suction port spatially communicates with an inside of the fixed cavity and the cavity, an air suction end of the air suction mechanism is located at the air suction port, a plurality of wind power distribution holes are correspondingly provided on the wind power distribution network, the plurality of wind power distribution holes are evenly distributed on the wind power distribution network, and hole diameters of the plurality of wind power distribution holes are arranged to gradually decrease from the first end toward the second end.

In preferred embodiments, the fixed cavity includes a first distribution cavity and a second distribution cavity that spatially communicate with each other. The first distribution cavity and the second distribution cavity respectively correspond to the first end and the second end, the air suction port spatially communicates with the first distribution cavity, a bottom surface of the first distribution cavity is lower than a bottom surface of the second distribution cavity, and a ramp is provided between the bottom surface of the first distribution cavity and the bottom surface of the second distribution cavity.

In preferred embodiments, the wind power distribution mechanism further includes a wind power distribution frame, the wind power distribution frame is plug-fitted into the fixed cavity, and the wind power distribution frame is arranged below the wind power distribution network.

In preferred embodiments, the housing and the fixed cavity are respectively provided with a first plug-in port and a second plug-in port for correspondingly and fittingly being engaged to the wind power distribution frame. The first plug-in port and the second plug-in port are arranged opposite to each other, one side of the wind power distribution frame passes through the first plug-in port and the second plug-in port in sequence and then abuts against an inner wall of the fixed cavity, and a fixed member for fixing the wind power distribution frame is provided in the fixed cavity so that the wind power distribution frame stably distributes a suction force in the fixed cavity.

In preferred embodiments, the fixed member has a mounting slot provided on the inner wall of the fixed cavity, a clamping block disposed in the mounting slot, and a clip block disposed on a side wall of the wind power distribution frame. The mounting slot is located on a side of the fixed cavity facing the second plug-in port, an opening of the clamping block faces the second plug-in port, the clip block is located on a side where the wind power distribution frame extends into the fixed cavity, and when the wind power distribution frame extends into the fixed cavity, the clip block extends into the clamping block.

In preferred embodiments, the air suction mechanism includes a vortex fan.

In preferred embodiments, a circuit board is further provided in the housing, the circuit board is located on the vortex fan and electrically connected to the vortex fan, and a gear adjustment key for adjusting an output power of the vortex fan is provided on the circuit board.

By means of the aforementioned technical solutions, the present disclosure has the following beneficial effects.

1. When the present disclosure is applied to remove or polish nails for a customer, the manicurist's hand is placed on the first end of the dust suction port, and the customer's hand is placed on the first end of the dust suction port. One hand of the manicurist holds the customer's finger that needs manicure, and the other hand holds the grinder. Then, the grinder is turned on to polish the customer's finger nails. At this time, the manicurist's hand, the customer's hand, the first end of the dust suction port and the second end of the dust suction port cooperate to form a trumpet-shaped vortex air outlet, which continuously provides a suction force to the dust suction port through the air suction mechanism, thereby improving the collection effect of dust particles, that is, improving the dust collection effect of the dust suction port. The suction force provided by the air suction mechanism is distributed through the wind power distribution mechanism, so that the suction force at the first end of the dust suction port is greater than the suction force at the second end of the dust suction port, and most of the dust particles flying to the manicurist can be sucked by the first end of the dust suction port, thereby reducing the concentration of dust particles at the manicurist's office while ensuring the health of the manicurist and reducing the risk of suffering from pneumoconiosis occupational diseases for the manicurist.

2. The present disclosure distributes the wind force at the dust suction port through the cooperation of the wind power distribution network, the first distribution cavity, the second distribution cavity and the wind power distribution frame, so that the suction force at the first end of the dust suction port is greater than the wind force at the second end of the dust suction port, and the suction force of the first end of the dust suction port is gradually reduced from the first end to the second end, which further improves the collection ability of dust particles at the first end of the dust suction port, promotes the dust suction effect, and further protects the health of the manicurist while achieving higher utilization of the suction force of the air suction mechanism and avoiding the waste of suction force. That is, the vortex fan with the same power has a better dust collection effect, thereby reducing the noise generated during the operation of the vortex fan and avoiding excessive noise that affects the customer's experience.

BRIEF DESCRIPTION OF THE DRAWINGS

In order to explain the embodiments of the present disclosure or the technical solutions in the prior art more clearly, the drawings needed to be used in the description of the embodiments or the prior art will be briefly introduced below. Obviously, the drawings in the following description are only some embodiments of the present disclosure. For those of ordinary skill in the art, other drawings can be obtained based on these drawings without exerting any creative effort.

Figure 1:
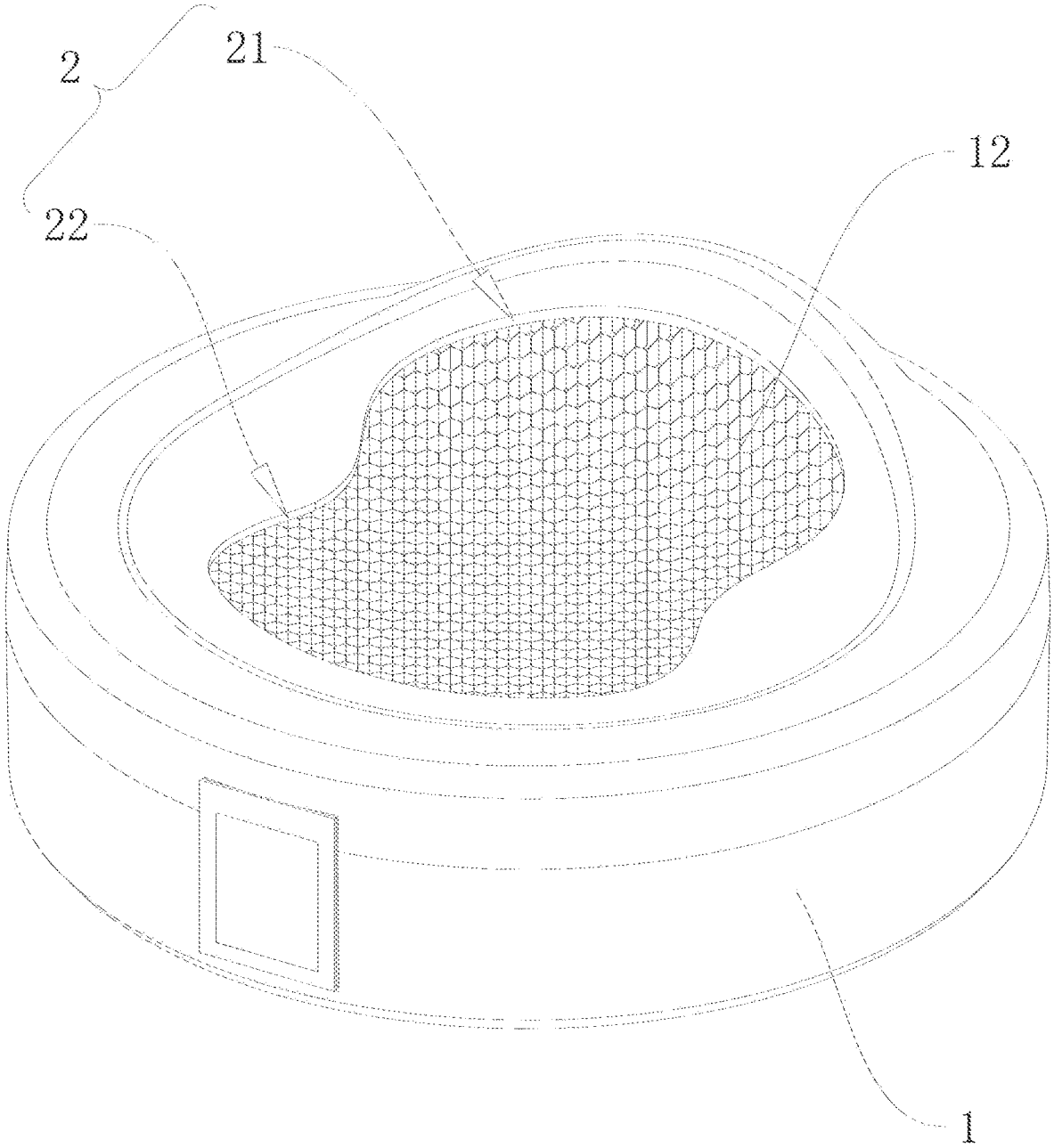
FIG. 1 is a schematic diagram of the overall structure of the present embodiment.

Reference numeral: 1, housing; 11, cavity; 12, filtering net; 13, first plug-in port; 2, dust suction port; 21, first end; 22, second end; 3, vortex fan; 4, wind power distribution mechanism; 41, fixed cavity; 411, first distribution cavity; 412, second distribution cavity; 413, ramp; 414, second plug-in port; 415, mounting slot; 416, clamping block; 42, air suction port; 43, wind power distribution network; 431, wind power distribution hole; 44, wind power distribution frame; 441, clip block; 5, circuit board; 51, function adjustment key; 61, drainage cavity; 62, collection port; 63, arc plate; 64, collection cavity; 65, dust exhaust port; 66, baffle; 67, battery frame; 71, charging port; 72, charging circuit.

DETAILED DESCRIPTION OF THE EXEMPLARY EMBODIMENTS

The present disclosure will be described in detail below in conjunction with FIGS. 1-5.

The specific embodiment is only an explanation of the present disclosure, and it is not a limitation of the present disclosure. Those skilled in the art can make modifications to the present embodiment without creative contribution as needed after reading this specification. However, as long as they are used as in the present disclosure, they are protected by patent law within the scope of the claims.

Figure 2:
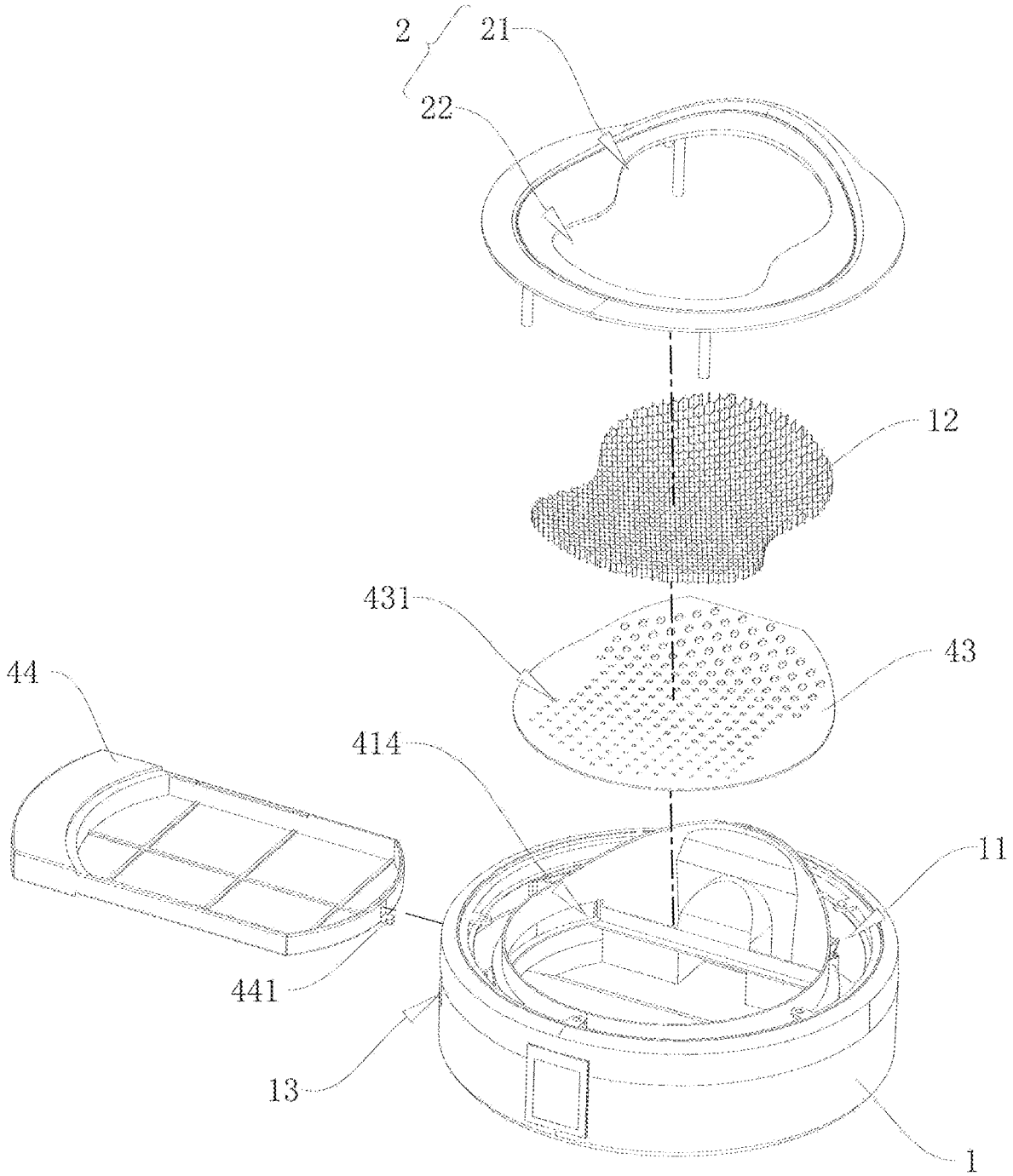
FIG. 2 is a partial exploded view of the present embodiment.

The present embodiment relates to a manicure dust suction device for collecting dust particles generated by nail polishing during manicure. Reference is made to FIGS. 1 and 2. The manicure dust suction device includes a housing 1 having a cavity 11 and a dust suction port 2 provided on the housing 1. In the present embodiment, the cross section of the housing 1 is circular, that is, the housing 1 is arranged in a roughly cylindrical shape. The cavity 11 is provided inside the housing 1, the dust suction port 2 is provided on the top of the housing 1, and the dust suction port 2 is connected with the cavity 11.

The dust suction port 2 has a first end 21 and a second end 22. The first end 21 is higher than the second end 22. The first end 21 and the second end 22 are connected to each other. The connection between the first end 21 and the second end 22 is arranged in a circular arc, and the first end 21 and the second end 22 complement each other to form an "8" shape. It should be noted that when polishing the customer's fingers, the manicurist's hand is placed on the first end 21, and the customer's hand is placed on the second end 22, that is, the first end 21 is the manicurist's end, and the second end 22 is the customer's end. At this time, one hand of the manicurist is holding the customer's finger that needs to be manicured, and the other hand of the manicurist is holding the grinder. When the grinder is turned on, the nail is polished. Due to the high-speed rotation of the grinder, most of the dust particles generated when polishing nails are raised upward and float to the manicurist's side, while a small part of the dust particles generated floats to the customer's side, so that the manicurist's hands, the customer's hands and the dust suction port 2 cooperate to form a trumpet-shaped vortex air outlet, thereby greatly improving the dust collection effect of the dust suction port 2.

Figure 3:
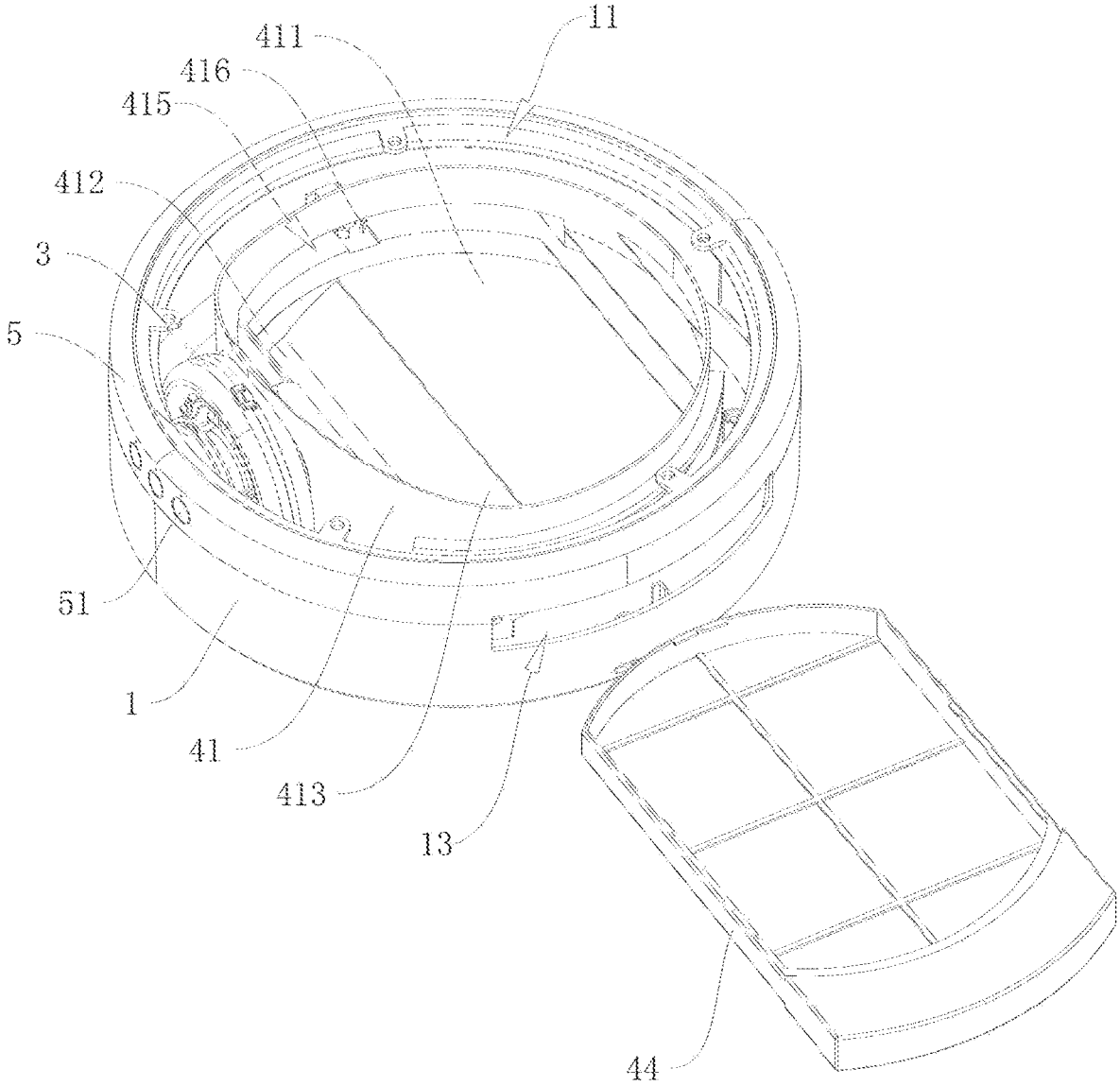
FIG. 3 is a diagram showing the cooperation relationship between the wind power distribution frame, the fixed cavity and the housing.

Reference is made to FIGS. 2 and 3. The housing 1 is provided with an air suction mechanism for providing a suction force to the dust suction port 2 so that the dust suction port 2 can collect dust particles generated by nail polishing. Specifically, the air suction mechanism includes a vortex fan 3 fixedly mounted in the cavity 11. The vortex mechanism includes an air suction end and an air outlet end, that is, the air suction end provides the suction force, so that the dust suction port 2 can remove dust particles generated by polishing nails. The dust particles enter the cavity 11 through dust suction port 2 and are sucked in from the suction end of the vortex fan 3 and discharged from the outlet end of the vortex fan 3.

The dust suction port 2 is provided with a filtering net 12 that matches the shape and size of dust suction port 2. The filtering net 12 is used to filter larger particles generated during grinding, such as large pieces of nail clippings, etc., thereby making it difficult for larger particles to enter into the cavity 11.

Reference is made to FIGS. 2 and 3. The cavity 11 is provided with a wind power distribution mechanism 4 for distributing a suction force provided by the vortex fan 3, so that a suction force at the first end 21 of the dust suction port 2 is greater than a suction force at the second end 22 of the dust suction port 2.

It is understandable that when polishing nails, due to the high-speed rotation of the polisher, most of the dust particles generated by polishing are raised to a certain height, and most of the dust particles float towards the first end 21 (the manicurist's end). If the suction forces of the first end 21 of the dust suction port 2 and the suction forces of the second end 22 of the dust suction port 2 are equal, some of the rising dust particles will be difficult to collect. Therefore, in order to improve the dust suction effect, the suction force of the first end 21 of the dust suction port 2 needs to be greater than the suction force of the second end 22 of the dust suction port 2.

Specifically, the wind power distribution mechanism 4 has a fixed cavity 41 fixedly provided in the housing 1, an air suction port 42 provided on the side wall of the fixed cavity 41, and a wind power distribution network 43 provided on the fixed cavity 41. The interior of the fixed cavity 41 is hollow, and a gap is provided between the bottom of the fixed cavity 41 and the bottom wall of the cavity 11. The fixed cavity 41 has a top opening, and the size of the opening of the fixed cavity 41 matches the dust suction port 2. The air suction port 42 penetrates through the side wall of the fixed cavity 41, and the air suction port 42 is connected to the inside of the fixed cavity 41 and the cavity 11. The air suction end of the vortex fan 3 is located at the air suction port 42. A plurality of wind power distribution holes 431 are provided on the wind power distribution network 43. The plurality of wind power distribution holes 431 are evenly distributed on the wind power distribution network 43, and the diameters of the plurality of wind power distribution holes 431 are gradually reduced from the first end 21 toward the second end 22.

It can be understood that through the arrangement of the wind power distribution holes 431 on the wind power distribution network 43, the suction force of the first end 21 of the dust suction port 2 is greater than the suction force of the second end 22 of the dust suction port 2, and the suction force of the dust suction port 2 gradually decreases in the direction from the first end 21 to the second end 22, thereby improving the ability of the first end 21 to collect dust particles generated by grinding and the dust collection effect.

Further, the fixed cavity 41 includes a first distribution cavity 411 and a second distribution cavity 412 that spatially communicate with each other. The first distribution cavity 411 and the second distribution cavity 412 respectively correspond to the first end 21 of the dust suction port 2 and the second end 22 of the dust suction port 2. That is, the first distribution cavity 411 is located directly below the first end 21 of the dust suction port 2, and the second distribution cavity 412 is located directly below the second end 22 of the dust suction port 2. The air suction port 42 is connected to the first distribution cavity 411. The bottom surface of the first distribution cavity 411 is lower than the bottom surface of the second distribution cavity 412, and a ramp 413 is provided between the bottom surface of the first distribution cavity 411 and the bottom surface of the second distribution cavity 412 to embody the connection transition between the bottoms of the first distribution cavity 411 and the second distribution cavity 412.

Furthermore, the wind power distribution mechanism 4 includes a wind power distribution frame 44, and the wind power distribution frame 44 is plug-fitted into the fixed cavity 41 and arranged below the wind power distribution network 43.

The housing 1 and the fixed cavity 41 are respectively provided with a first plug-in port 13 and a second plug-in port 414 for fittingly being engaged to the wind power distribution frame 44. The first plug-in port 13 and the second plug-in port 414 are arranged opposite to each other, and one side of the wind power distribution frame 44 passes through the first plug-in port 13 and the second plug-in port 414 in sequence and then abuts against the inner wall of the fixed cavity 41. A fixed member for fixing the wind power distribution frame 44 is provided in the fixed cavity 41, so that the wind power distribution frame 44 stably distributes the suction force in the fixed cavity 41.

Specifically, the fixed member has a mounting slot 415 provided on the inner wall of the fixed cavity 41, a clamping block 416 disposed in the mounting slot 415, and a clamping block 441 disposed on the side wall of the wind power distribution frame 44. The mounting slot 415 is located on the side of the fixed cavity 41 facing the second plug-in port 414, the clamping block 416 has an elastic clamping part, the opening of the clamping block 416 is located on the clamping part, and the opening of the clamping block 416 faces the second plug-in port 414. The clamping block 441 is fixedly mounted on the side of the wind power distribution frame 44 that extends into the fixed cavity 41. The clamping block 441 is provided with an arc-shaped guide groove, and when the wind power distribution frame 44 extends into the fixed cavity 41 and abuts against the mounting slot 415, the clamping block 441 extends into the opening of the clamping block 416.

Figure 4:
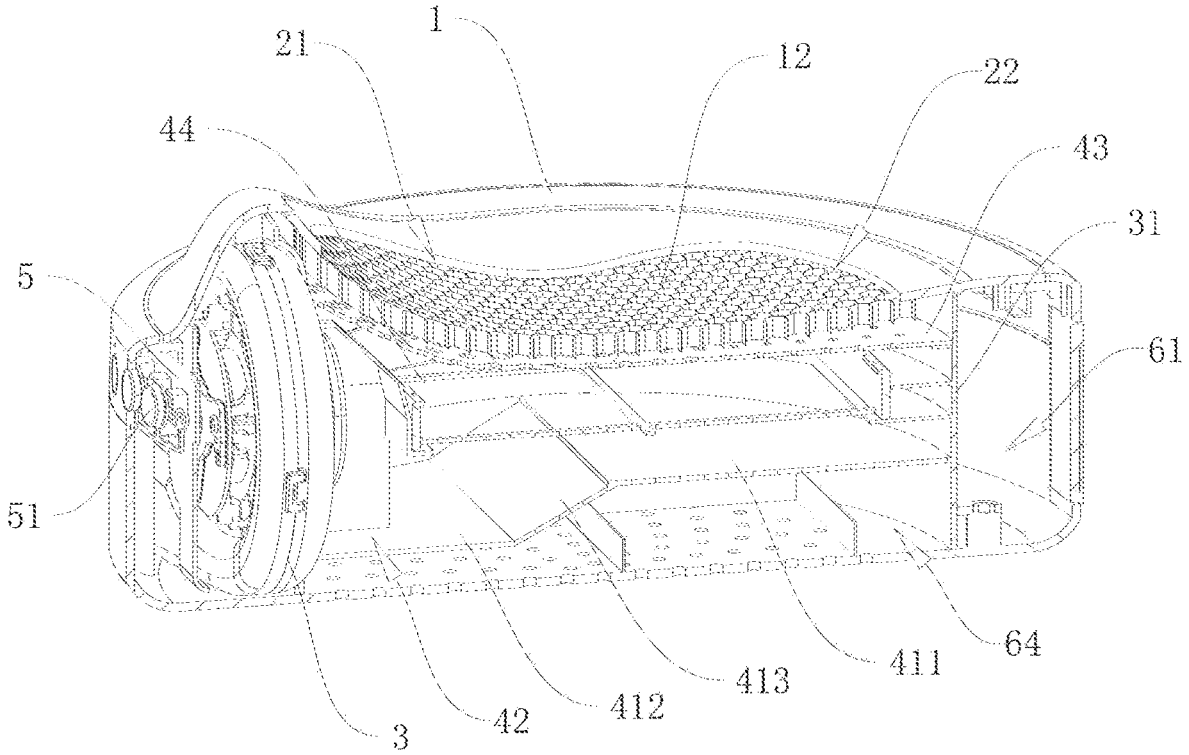
FIG. 4 is a partial cross-sectional view of the present embodiment.

Further, reference is made to FIGS. 3 and 4. A circuit board 5 is provided in the housing 1. The circuit board 5 is located on the vortex fan 3 and is electrically connected to the vortex fan 3. The circuit board 5 is provided with a gear adjustment key for adjusting the output power of the vortex fan 3. The gear adjustment key is used to adjust the output power of the vortex fan 3, thereby adjusting the suction force of the first end 21 of the dust suction port 2 and the suction force of the second end 22 of the dust suction port 2. In the present embodiment, the number of gear adjustment keys is three. The three gear adjustment keys are all located on the side wall of the housing 1, and the three gear adjustment keys are all electrically connected to the circuit board 5.

Furthermore, a dust particle collection mechanism is provided in the housing 1, and the dust collection mechanism is used to collect the dust particles sucked by the vortex fan 3.

Figure 5:
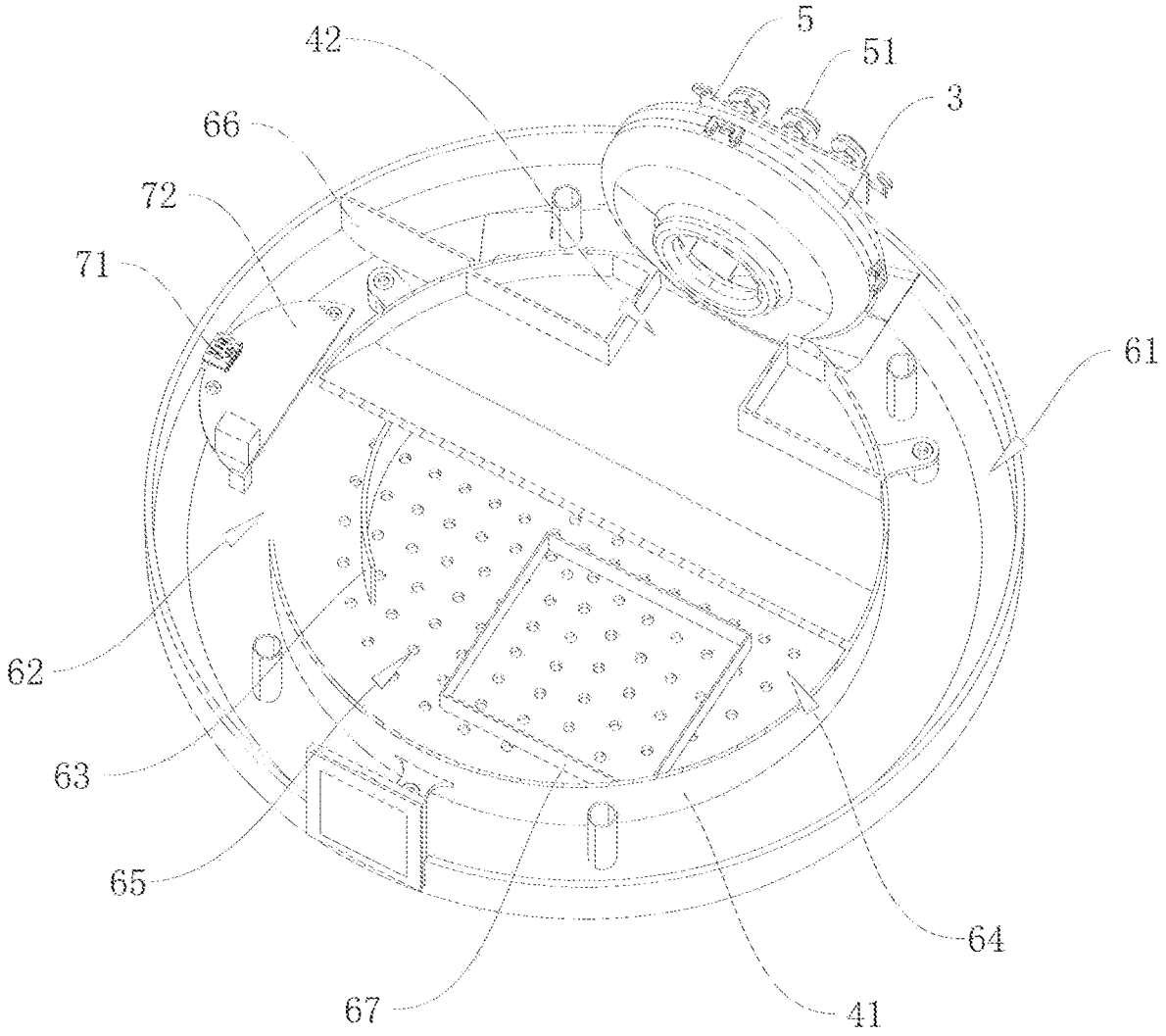
FIG. 5 is a schematic diagram showing the cooperation relationship between the dust collection mechanism and the housing.

Specifically, reference is made to FIGS. 4 and 5. The dust collection mechanism includes a drainage cavity 61 formed by the cooperation between the inner wall of the housing 1 and the side wall of the fixed cavity 41, a collection port 62 provided on the bottom side of the fixed cavity 41, and an arc plate 63 provided at the collection port 62. A collection cavity 64 is formed by the cooperation between the bottom side of the fixed cavity 41 and the housing 1, and a plurality of dust exhaust ports 65 are provided on the bottom side of the housing 1. The drainage cavity 61 is arranged in an arc shape, and the air outlet end of the vortex fan 3 is located in the drainage cavity 61. The collection port 62 is located on the side wall of the fixed cavity 41. The collection port 62 penetrates the side wall of the fixed cavity 41. The arc plate 63 is fixedly mounted in the collection cavity 64, and the recessed part of the arc plate 63 is arranged in the direction away from the collection port 62. The collection cavity 64 is connected to the drainage cavity 61 through the collection port 62, so that the dust particles sucked in by the vortex fan 3 are discharged from the air outlet end of the vortex fan 3 into the drainage cavity 61 and then enter the collection cavity 64 through the collection port 62. A plurality of dust exhaust ports 65 are provided and the plurality of dust exhaust ports 65 all penetrate the bottom of the housing 1 and are all connected to the collection cavity 64.

The drainage cavity 61 is further provided with a baffle 66, and the baffle 66 is located on one side of the collection port 62 to block dust particles, so that the dust particles enter the collection cavity 64 through the collection port 62 and then are discharged outside the housing 1 from the dust discharge port 65.

In addition, the collection cavity 64 is further provided with a battery frame 67. The battery frame 67 is provided with a battery, and the battery is electrically connected to the circuit board 5. A charging port 71 is provided on the side wall of the housing 1, and the charging port 71 is electrically connected to a charging circuit 72 board. The charging circuit 72 board is located at the collection port 62, and the charging circuit 72 board is electrically connected to the battery.

The working principle of the present disclosure is roughly as follows. When polishing the customer's fingers, the manicurist's hand is placed on the first end 21, and the customer's hand is placed on the second end 22. Then, one hand of the manicurist holds the customer's finger that needs manicure, and the other hand of the manicurist holds the grinder. When the grinder is turned on, the nail is polished. At this time, the manicurist's hand, the customer's hand and the dust suction port 2 cooperate to form a trumpet-shaped vortex air outlet, and the vortex fan 3 continuously provides a suction force to the dust suction port 2, thereby greatly improving the dust collection effect of the dust suction port 2.

By means of the cooperation of the wind power distribution network 43, the first distribution cavity 411, the second distribution cavity 412, the ramp 413 and the wind power distribution frame 44, the suction force of the first distribution cavity 411 is smaller than the suction force of the second distribution cavity 412, thereby making the suction force of the first end 21 of the dust suction port 2 greater than the suction force of the second end 22 of the dust suction port 2, so as to improve the utilization of the suction force provided by the vortex fan 3. That is, when the output power of the vortex fan 3 remains constant, the second dust suction port can suck more dust particles, thereby improving the dust suction effect and reducing the concentration of dust particles at the manicurist's office, while reducing the manicurist's risk of suffering from pneumoconiosis occupational diseases.

The present disclosure has been described in detail through specific embodiments. These detailed descriptions are only intended to help those skilled in the art understand the content of the present disclosure and cannot be construed as limiting the scope of the present disclosure. Various modifications, equivalent transformations, etc. made to the above solutions by those skilled in the art under the concept of the present disclosure should be included in the protection scope of the present disclosure.

What is claimed is:

1. A manicure dust suction device, including a housing (1) having a cavity (11) and a dust suction port (2) provided on the housing (1), wherein the dust suction port (2) has a first end (21) and a second end (22), the first end (21) is higher than the second end (22), the housing (1) is further provided with an air suction mechanism for providing a suction force to the dust suction port (2) so that the dust suction port (2) is capable of collecting dust particles generated during nail polishing and nail removal;

wherein the housing (1) is provided with a wind power distribution mechanism (4) for distributing the suction force provided by the air suction mechanism so that a suction force at the first end (21) is greater than a suction force at the second end (22).

2. The manicure dust suction device according to claim 1, wherein the first end (21) is connected to the second end (22), a connection between the first end (21) and the second end (22) is arranged in a circular arc, and the first end (21) and the second end (22) complement each other to form an "8" shape.

3. The manicure dust suction device according to claim 1, wherein the wind power distribution mechanism (4) has a fixed cavity (41) fixedly provided in the housing (1), an air suction port (42) provided on a side wall of the fixed cavity (41), and a wind power distribution network (43) provided on the fixed cavity (41); the fixed cavity (41) is fixedly located in the cavity (11), the air suction port (42) spatially communicates with an inside of the fixed cavity (41) and the cavity (11), an air suction end of the air suction mechanism is located at the air suction port (42), a plurality of wind power distribution holes (431) are correspondingly provided on the wind power distribution network (43), the plurality of wind power distribution holes (431) are evenly distributed on the wind power distribution network (43), and hole diameters of the plurality of wind power distribution holes (431) are arranged to gradually decrease from the first end (21) toward the second end (22).

4. The manicure dust suction device according to claim 3, wherein the fixed cavity (41) includes a first distribution cavity (411) and a second distribution cavity (412) that spatially communicate with each other, the first distribution cavity (411) and the second distribution cavity (412) respectively correspond to the first end (21) and the second end (22), the air suction port (42) spatially communicates with the first distribution cavity (411), a bottom surface of the first distribution cavity (411) is lower than a bottom surface of the second distribution cavity (412), and the first distribution cavity (411) and the second distribution cavity (412) have a transition ramp (413) therebetween.

5. The manicure dust suction device according to claim 4, wherein the wind power distribution mechanism (4) further includes a wind power distribution frame (44), the wind power distribution frame (44) is plug-fitted into the fixed cavity (41), and the wind power distribution frame (44) is arranged below the wind power distribution network (43).

6. The manicure dust suction device according to claim 5, wherein the housing (1) and the fixed cavity (41) are respectively provided with a first plug-in port (13) and a second plug-in port (414) for correspondingly and fittingly engaged to the wind power distribution frame (44), the first plug-in port (13) and the second plug-in port (414) are arranged opposite to each other, one side of the wind power distribution frame (44) passes through the first plug-in port (13) and the second plug-in port (414) in sequence and then abuts against an inner wall of the fixed cavity (41), and a fixed member for fixing the wind power distribution frame (44) is provided in the fixed cavity (41) so that the wind power distribution frame (44) stably distributes a suction force in the fixed cavity (41).

7. The manicure dust suction device according to claim 6, wherein the fixed member has a mounting slot (415) provided on the inner wall of the fixed cavity (41), a clamping block (416) disposed in the mounting slot (415), and a clip block (441) disposed on a side wall of the wind power distribution frame (44); the mounting slot (415) is located on a side of the fixed cavity (41) facing the second plug-in port (414), an opening of the clamping block (416) faces the second plug-in port (414), the clip block (441) is located on a side where the wind power distribution frame (44) extends into the fixed cavity (41), and wherein, when the wind power distribution frame (44) extends into the fixed cavity (41), the clip block (441) extends into the clamping block (416).

8. The manicure dust suction device according to claim 3, wherein the wind power distribution mechanism (4) further includes a wind power distribution frame (44), the wind power distribution frame (44) is plug-fitted into the fixed cavity (41), and the wind power distribution frame (44) is arranged below the wind power distribution network (43).

9. The manicure dust suction device according to claim 8, wherein the housing (1) and the fixed cavity (41) are respectively provided with a first plug-in port (13) and a second plug-in port (414) for correspondingly and fittingly engaged to the wind power distribution frame (44), the first plug-in port (13) and the second plug-in port (414) are arranged opposite to each other, one side of the wind power distribution frame (44) passes through the first plug-in port (13) and the second plug-in port (414) in sequence and then abuts against an inner wall of the fixed cavity (41), and a fixed member for fixing the wind power distribution frame (44) is provided in the fixed cavity (41) so that the wind power distribution frame (44) stably distributes a suction force in the fixed cavity (41).

10. The manicure dust suction device according to claim 9, wherein the fixed member has a mounting slot (415) provided on the inner wall of the fixed cavity (41), a clamping block (416) disposed in the mounting slot (415), and a clip block (441) disposed on a side wall of the wind power distribution frame (44); the mounting slot (415) is located on a side of the fixed cavity (41) facing the second plug-in port (414), an opening of the clamping block (416) faces the second plug-in port (414), the clip block (441) is located on a side where the wind power distribution frame (44) extends into the fixed cavity (41), and wherein, when the wind power distribution frame (44) extends into the fixed cavity (41), the clip block (441) extends into the clamping block (416).

11. The manicure dust suction according to claim 1, wherein the air suction mechanism includes a vortex fan (3).

12. The manicure dust suction according to claim 11, wherein a circuit board (5) is further provided in the housing (1), the circuit board (5) is located on the vortex fan (3), the circuit board (5) is electrically connected to the vortex fan (3), and a gear adjustment key for adjusting an output power of the vortex fan (3) is provided on the circuit board (5).

* * * * *